United States Patent [19]

Raymer et al.

[11] Patent Number: 4,783,002

[45] Date of Patent: Nov. 8, 1988

[54] DRINKING FOUNTAIN

[75] Inventors: Doyle Raymer, Davis; Dipak J. Negandhi, Freeport, both of Ill.; Dennis J. Heyden, Browntown; Robert L. Latzko, Wauwatosa, both of Wis.

[73] Assignee: King-Seeley Thermos Company, Prospect Heights, Ill.

[21] Appl. No.: 14,534

[22] Filed: Feb. 13, 1987

[51] Int. Cl.[4] ..... E03B 9/20

[52] U.S. Cl. ..... 239/29

[58] Field of Search ..... 4/623, 643; 239/24, 239/25, 28, 29, 29.3, 29.5; D7/304

[56] References Cited

U.S. PATENT DOCUMENTS

| | | | |
|---|---|---|---|
| 2,279,374 | 4/1942 | Jang | 239/28 X |
| 2,739,461 | 3/1956 | Canter | 239/29.5 |
| 3,576,277 | 4/1971 | Blackmon | 4/623 X |
| 4,520,960 | 6/1985 | Cushman et al. | 239/29 |
| 4,670,010 | 6/1987 | Pragone | 4/623 X |

FOREIGN PATENT DOCUMENTS

| | | | |
|---|---|---|---|
| 546763 | 10/1957 | Canada | 239/29 |

*Primary Examiner*—Andres Kashnikow
*Assistant Examiner*—Kevin P. Weldon
*Attorney, Agent, or Firm*—Harness, Dickey & Pierce

[57] ABSTRACT

The barrier free drinking fountain has an oval-shaped basin which rests on an extended cantilevered arm. The basin is an assembly of an upper bowl and a lower bowl which are assembled on the waste removal pipe and which may be readily disassembled without breaking adhesive seals. The push actuator is semicylindrically-shaped to provide a manually accessible surface spanning approximately 180°. The push actuator moves both translationally and rotationally, depending on where the actuator is pushed. Translational and rotational movement of the actuator causes the water dispensing valve to operate.

20 Claims, 8 Drawing Sheets

DRINKING FOUNTAIN

BACKGROUND AND SUMMARY OF THE INVENTION

The present invention relates generally to barrier free drinking fountains. More particularly, the invention relates to a drinking fountain having an oval-shaped basin assembly which rests upon an extended cantilevered arm. The invention further relates to a semicylindrical actuating member which makes it possible to actuate the fountain by manually contracting the actuating member at any point along its semicylindrical arc.

Barrier free water coolers which utilize a bowl resting on top of and at the front end of an extended arm have been traditionally circular or rectangular in shape. The circular-shaped bowl has the disadvantage of placing the water dispensing nozzle at a difficult to access position for some handicapped users. The rectangular-shaped bowl can present rectangular corners which may catch clothing, jewelry and the like. Both circular and rectangular-shaped bowls present other problems from the architectural aesthetics standpoint.

In addition to the aforementioned shortcomings of conventional cantilevered barrier free water fountains, many conventional fountain designs are difficult to clean. Conventional fountains have drain holes located in the lowest point of the bowl for drainage of water. The drain connections are usually made from underneath the bowl, making it very difficult to clean the drain in case of a clog, unless the top bowl is first disjointed and removed. Some currently available fountains attach the drain to the bowl by means of an adhesive gasket which is formed in place. This type of joint is quite susceptible to leaks and makes it extremely difficult to service any clogged drain lines. Some fountains use upper and lower bowl sections which are joined together at the outer periphery with a silicon adhesive seal. In order to disassemble such fountains for cleaning, it is necessary to break and remove the adhesive seal so that the two bowl halves can be separated. This is a messy and time-consuming job. Once servicing has been completed, the adhesive seal must be replaced, another messy and time-consuming job.

Heretofore, some drinking fountains of this type have employed push-bar, push-pad or push button means for actuating the drinking fountain. Such means of actuation are usually confined to a relatively small push area, nominally two inches by four inches. Some fountains are equipped with one or more such push areas.

In providing barrier free water fountains for use by handicapped people, it is an objective to have an actuator which can be operated with low pushing force. Some prior art push actuators require too much force and are thus unsuitable for use by handicapped persons. Present government regulations specify that the force necessary to actuate a water fountain for handicapped use must be less than five pounds. Although some conventional fountains can meet this requirement, the push actuator button surface area is often a relatively reduced size, on the order of two inches by four inches as explained above. While adequate for nonhandicapped persons, the actuator size and location can be critical for the handicapped person with limited use of the arms.

The present invention overcomes the foregoing disadvantages of prior art barrier free water fountains. It provides a cantilevered-style fountain having an oval-shaped water basin which can be drunk from more easily than conventional circular basins and without providing corners which may catch clothing, jewelry and the like. The basin comprises an assembly of components including an upper water receptor or upper bowl and a lower receptor liner or lower bowl, which are assembled on the waste removal plumbing in a fashion which permits the assembly to be readily disassembled for cleaning. The invention thus eliminates the need for adhesive seals which can deteriorate and leak and which must be removed and replaced for maintenance.

Further, the invention provides an improved drinking fountain having a water basin with a drain therein and a water dispensing means. A push actuator of semicylindrical configuration is operatively coupled to the water dispensing means for controlling the dispensing of water. The actuator has a stationary mounting portion secured to the fountain and has a movable manually contactable portion carried by the mounting portion. The manually contactable portion is carried for translational movement and also for rotational movement about at least one and preferably two axes from its position of rest. Either translational movement or rotational movement, or combinations of the two, cause water to be dispensed from the dispensing means.

The manually contactable portion of the actuator lies at least partially in a cylindrical plane. The manually contactable portion preferably comprises a semicylindrical push bar which is configured to lie generally in the semicylindrical plane defined by the frontal portion of the base or carrier arm upon which the receptor bowl is placed. The push bar thus permits the user to obtain a drink of water by pressing or manually contacting the bar at any position about the semicylindrical configuration, which preferably subtends an arc of approximately 180°. The push actuator is mounted generally flush with the frontal semicylindrical portion of the carrier arm or base so that the actuator provides no sharp edges or corners which might catch clothing or jewelry or the like.

For a more complete understanding of the invention, its objects and advantages, reference may be had to the following specification and to the accompanying drawings.

BRIEF DESCRIPTION OF THE DRAWINGS

FIG. 3 is a partial cross sectional view of the underside of the fountain;

DESCRIPTION OF THE PREFERRED EMBODIMENTS

Figure 1:
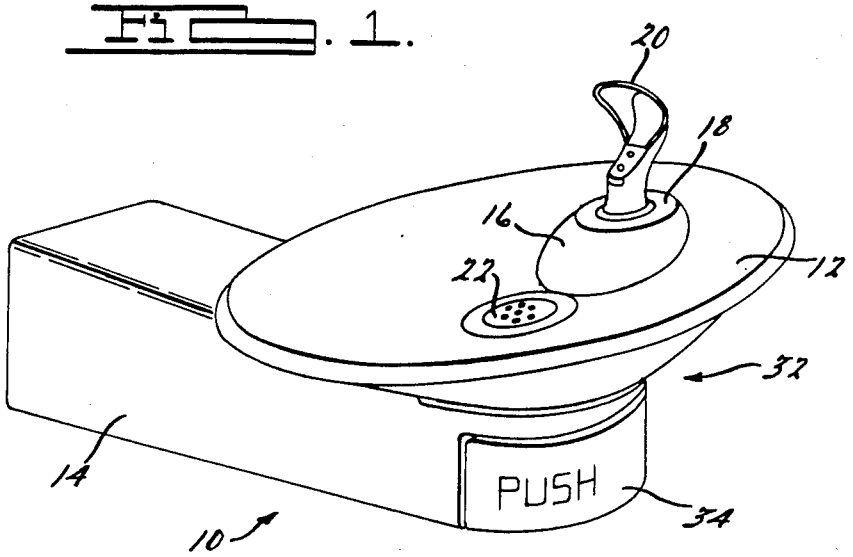
FIG. 1 is a perspective view of the water fountain of the invention.

The fountain of the invention is illustrated generally at 10. The fountain comprises a receptor basin 12 which is mounted upon a cantilevered carrier arm base 14. Formed in the top of basin 12 is a raised stream breaker 16 which also defines a raised mounting surface 18 upon which the water dispensing nozzle or projector nozzle 20 is mounted. The center portion of the basin is depressed so that all water falling within the basin is collected in the center where a drain assembly 22 is located.

Figure 2:
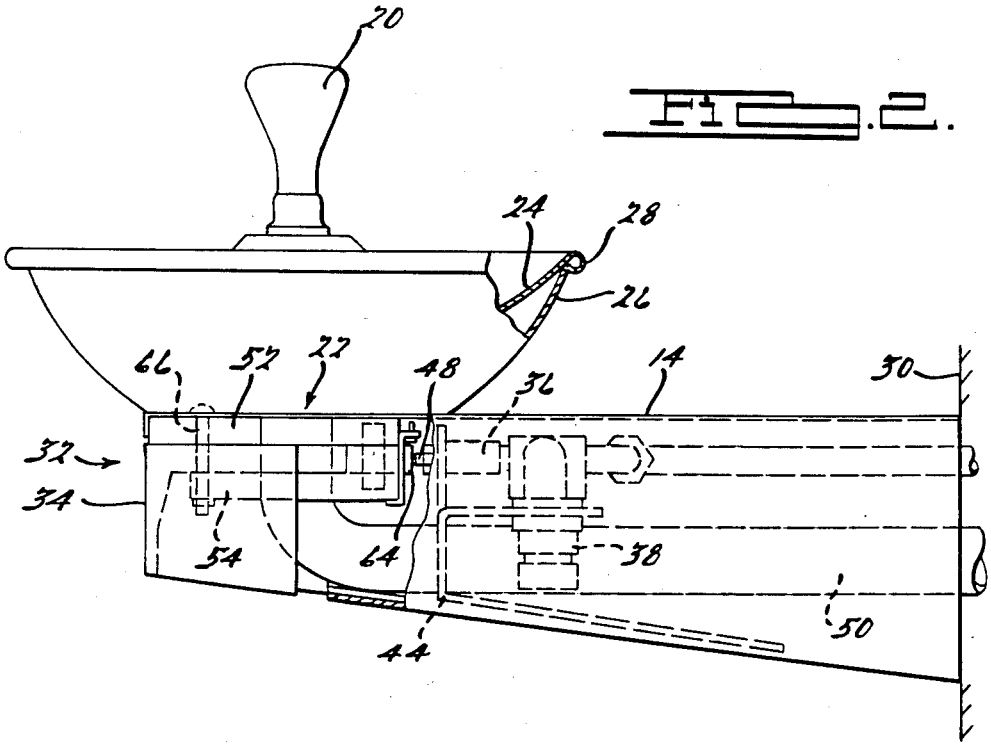
FIG. 2 is a right side view of the fountain of FIG. 1, showing the internal plumbing components in phantom.
Figure 2:
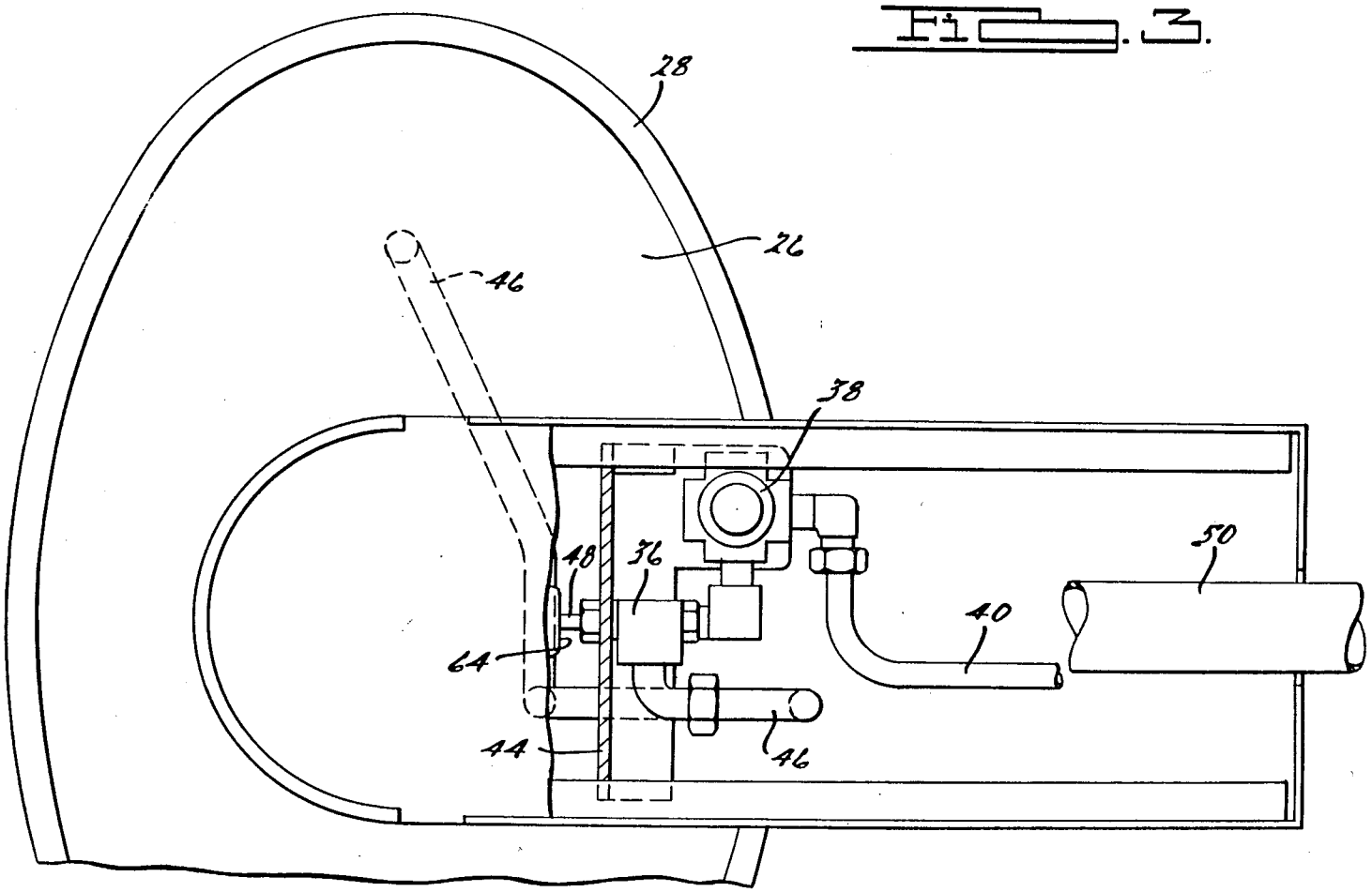

As seen in FIG. 2, basin 12 comprises an upper bowl 24 and a lower bowl 26. The upper bowl and lower bowl nest together, with the outer perimeter 28 of the upper bowl being rolled over approximately 300° to prevent any sharp edges from coming in contact with the user. The upper and lower bowls are both oval-shaped when viewed from directly above. The two bowls may be constructed of stainless steel, painted or coated sheet steel, sheet steel with a plastic laminate or nonmetallic (plastic) material. The lower bowl is disposed upon carrier arm 14 which is in turn cantilevered to a fixed point of support such as a wall 30. If desired, the carrier arm may be connected to a back panel which is used to mount the fountain on the wall. The lower bowl 26 is disposed proximate the frontal portion 32 of the carrier arm 14. The frontal portion of carrier arm 14 is preferably rounded in a semicylindrical configuration. The carrier arm may be constructed of stainless steel, painted or coated sheet steel, sheet steel with a plastic laminate or nonmetallic (plastic) material. A push actuator 34 is mounted on the carrier arm beneath the basin 12 in the position illustrated in FIG. 1. Preferably, the push actuator provides a semicylindrical push bar which includes a manually contactable outwardly facing portion which lies at least partially in a cylindrical plane. Preferably the cylindrical plane of the push bar lies generally in the semicylindrical plane of the frontal portion 32 of the carrier arm.

Referring to FIGS. 2 and 3, housed within carrier arm 14 is the valve 36 and regulator 38. Connected to the valve and regulator assembly is supply line 40 which is connected to a source of potable water. Preferably the valve and regulator are assembled together and secured in place by a bracket 44. The valve and regulator assembly is coupled through water supply line 46 to the water dispensing nozzle 20. Valve 36 includes valve operator shaft or stem 48 which, when depressed, opens the valve to allow potable water to flow from supply line 40 through the regulator and valve assembly and water supply line 46 for dispensing through the nozzle. Drain 22 is coupled to waste tube 50, which carries any waste water to the building sanitary system.

Figure 4:
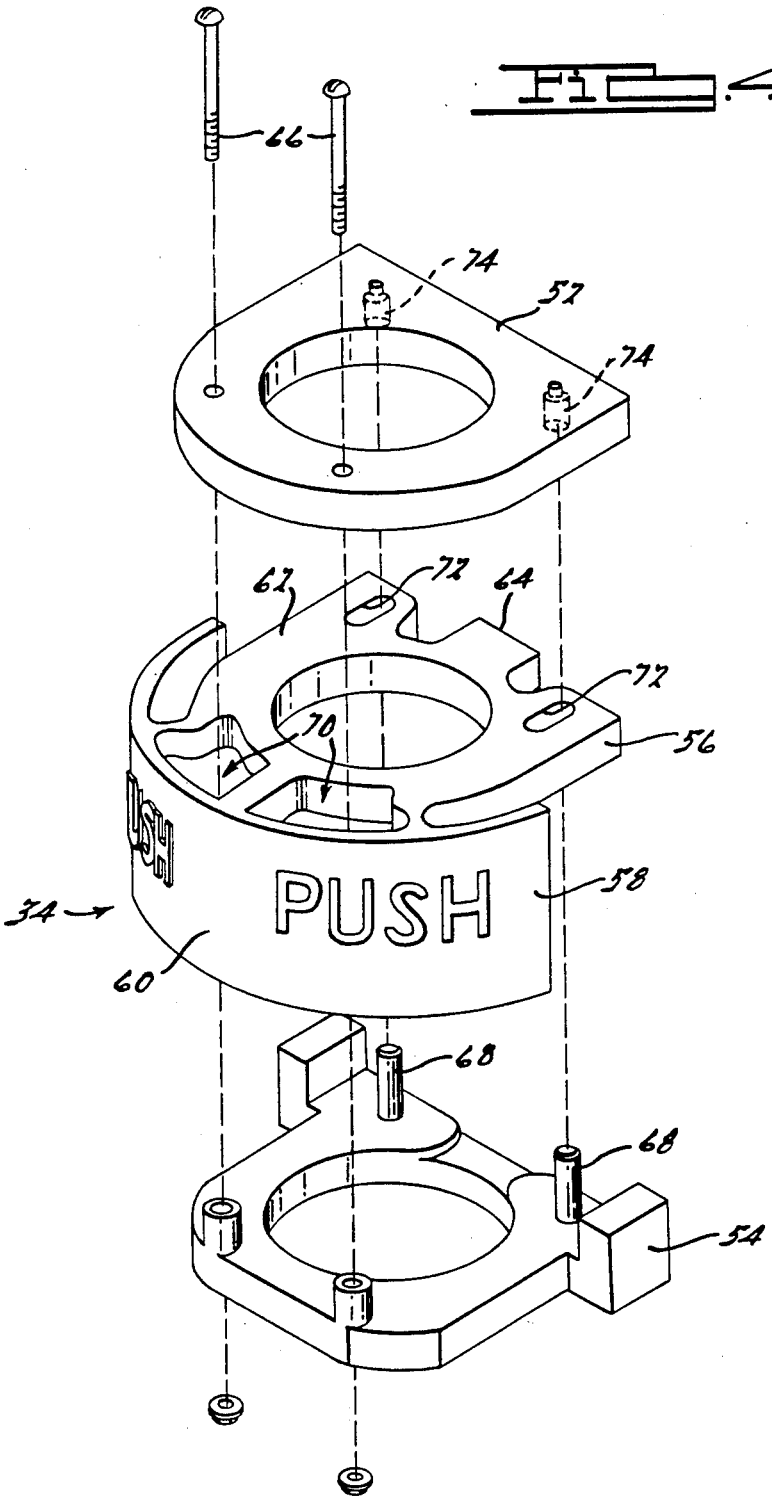
FIG. 4 is an exploded perspective view of the presently preferred push bar actuator.

The details of the push actuator 34 are shown in FIG. 4. Push actuator 34 comprises an upper mounting bracket 52 and a lower mounting bracket 54. Disposed between the mounting brackets is valve actuator member 56, which includes a semicylindrical push bar 58. The push bar includes a frontal manually accessible portion 60 which lies in a generally semicylindrical plane. Valve actuator member 56 includes a horizontally disposed plate portion 62 which has a rearwardly facing valve contacting portion 64 which, in use, contacts the valve operator stem to apply a pushing force to the stem causing the valve to open. The upper and lower mounting brackets are held together in registration by mounting bolts 66 and by lugs 68. The mounting bolts pass through openings 70 in plate portion 62 so that the bolts do not contact the plate 62. Lugs 68 pass through elongated openings 72 in plate portion 62 and are received in sockets 74 formed in the upper mounting bracket 52. Elongated openings 72 are sized to permit both translational (sliding) movement and also rotational movement of the plate portion 62 relative to lugs 68. The three components of the actuator (i.e., brackets 52 and 54 and member 56) may be made from plastics, die cast metal (zinc, aluminium, etc.), sintered metal (brass) or fabricated from sheet metal (or coated steel) and then painted.

Figure 5:
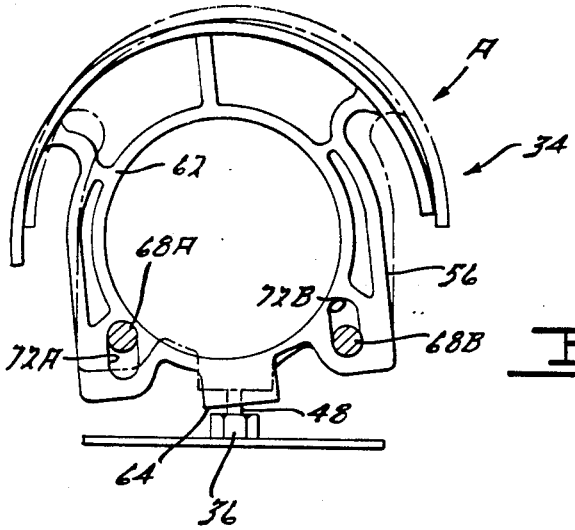
FIGS. 5, 6 and 7 are top views of the push bar actuator, illustrating the actuator in operation.
Figure 6:
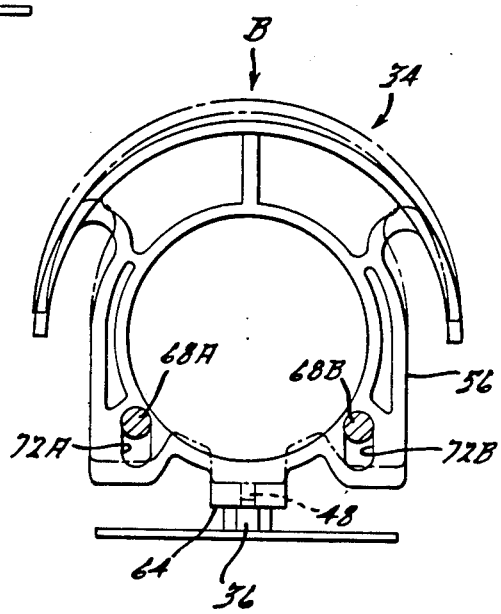
Figure 7:
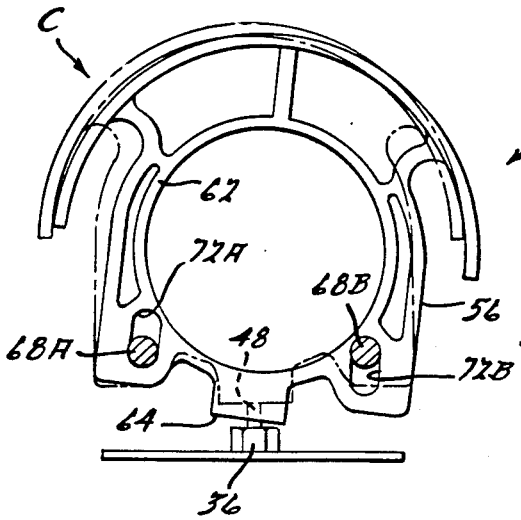

Referring to FIGS. 5, 6 and 7, the push actuator 34 is illustrated in operation. FIGS. 5, 6 and 7 depict the plate portion 62 of the valve actuator member 56. The upper and lower mounting brackets have been deleted from FIGS. 5, 6 and 7 to make the illustration more clear. Lugs 68A and B of lower mounting bracket 54 have been illustrated in the respective elongated openings 72A and B of plate portion 62. Also illustrated is the valve operator stem 48 of valve 36.

FIG. 5 depicts in dashed lines the position of the valve actuator member 56 in its position of rest. The valve 36 has a spring actuated valve operator stem which urges the valve actuator member to its resting position. FIG. 5 also illustrates in solid lines the position of valve actuator member 56 when a pushing force is applied to the manually accessible portion 60 generally at A. When the force is applied at this position, the plate portion 62 rotates about lug 68B. This rotating motion is accompanied by relative sliding movement between slot 72A and lug 68A. This rotational movement causes the valve contacting portion 64 to depress the valve operator stem 48, opening the valve and causing water to flow through the projector nozzle.

FIG. 6 depicts the operation when a manual force is applied to the front central portion of the manually accessible portion 60, generally at B. When such a force is applied, the plate portion 62 exhibits translational movement characterized by sliding movement of slot 72A relative to lug 68A and sliding movement of slot 72B relative to lug 68B. This movement causes the valve contacting portion 64 to depress the valve operator stem, causing water to flow as before.

In the final example of FIG. 7, a force is applied generally at C. This causes rotational movement of the plate portion 62 about lug 68A. This rotational movement is accompanied by sliding movement of slot 72B relative to lug 68B. The rotational movement causes the valve contacting portion 64 to depress the valve operator stem 48, causing water to flow as described above.

It will thus be seen that the push actuator 34 is capable of rotational movement and translational movement which causes the actuation of valve 36. The actuator is capable of being operated by applying a light pushing force to any point along the semicylindrical arc defined by the manually accessible portion 60. In the presently preferred embodiment, portion 60 subtends an arc of approximately 180°. The push actuator is capable of being operated quite easily by handicapped persons and meets the government five pound pushing force standard with better than a 300 percent safety factor. It also presents a large surface area which is easy to push and has room for large instructions or letters which could be embossed. Large and embossed letters are easier for visually handicapped people to read.

Figure 9:
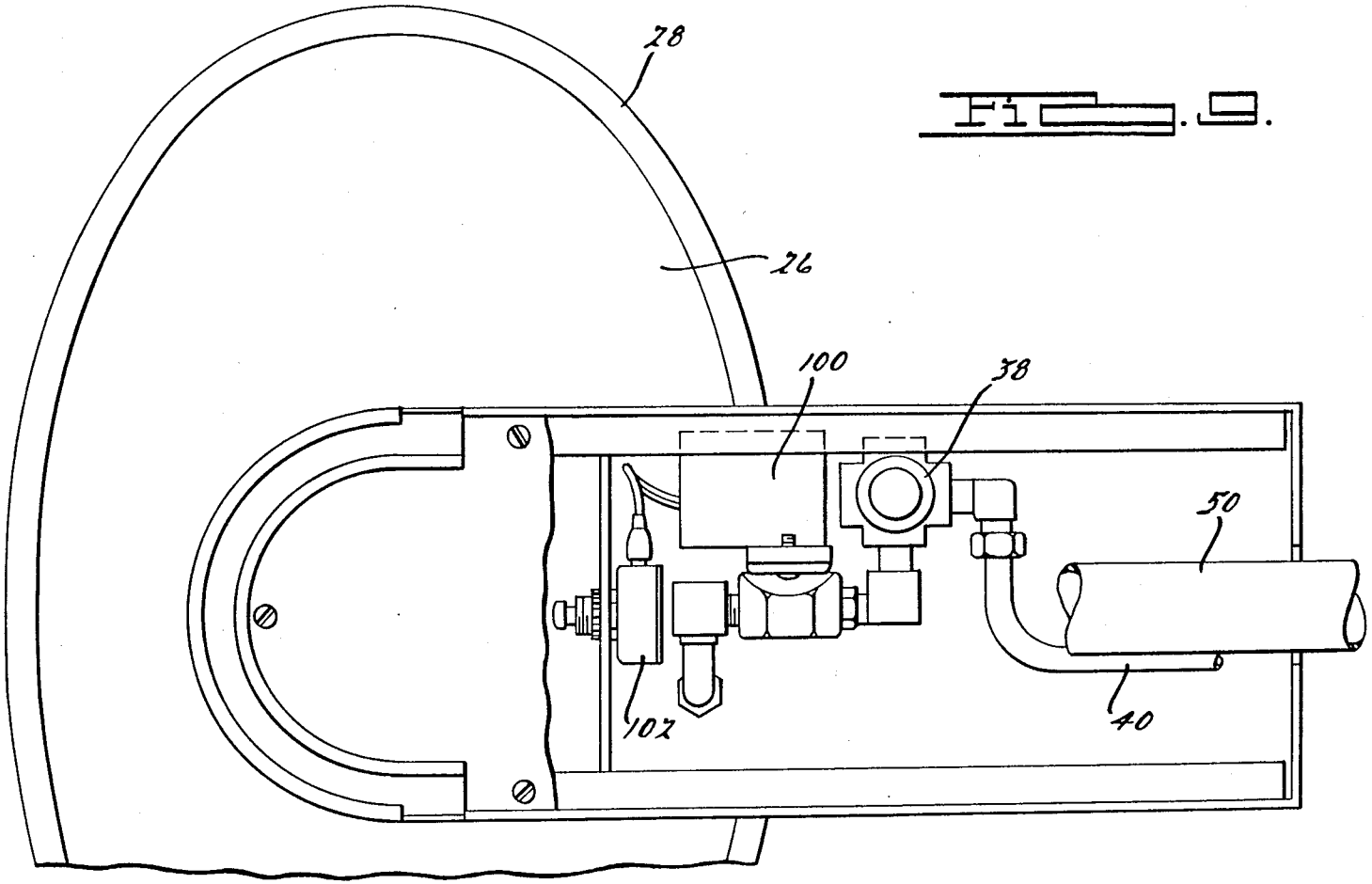
FIG. 9 depicts an alternate embodiment of actuator.
Figure 10:
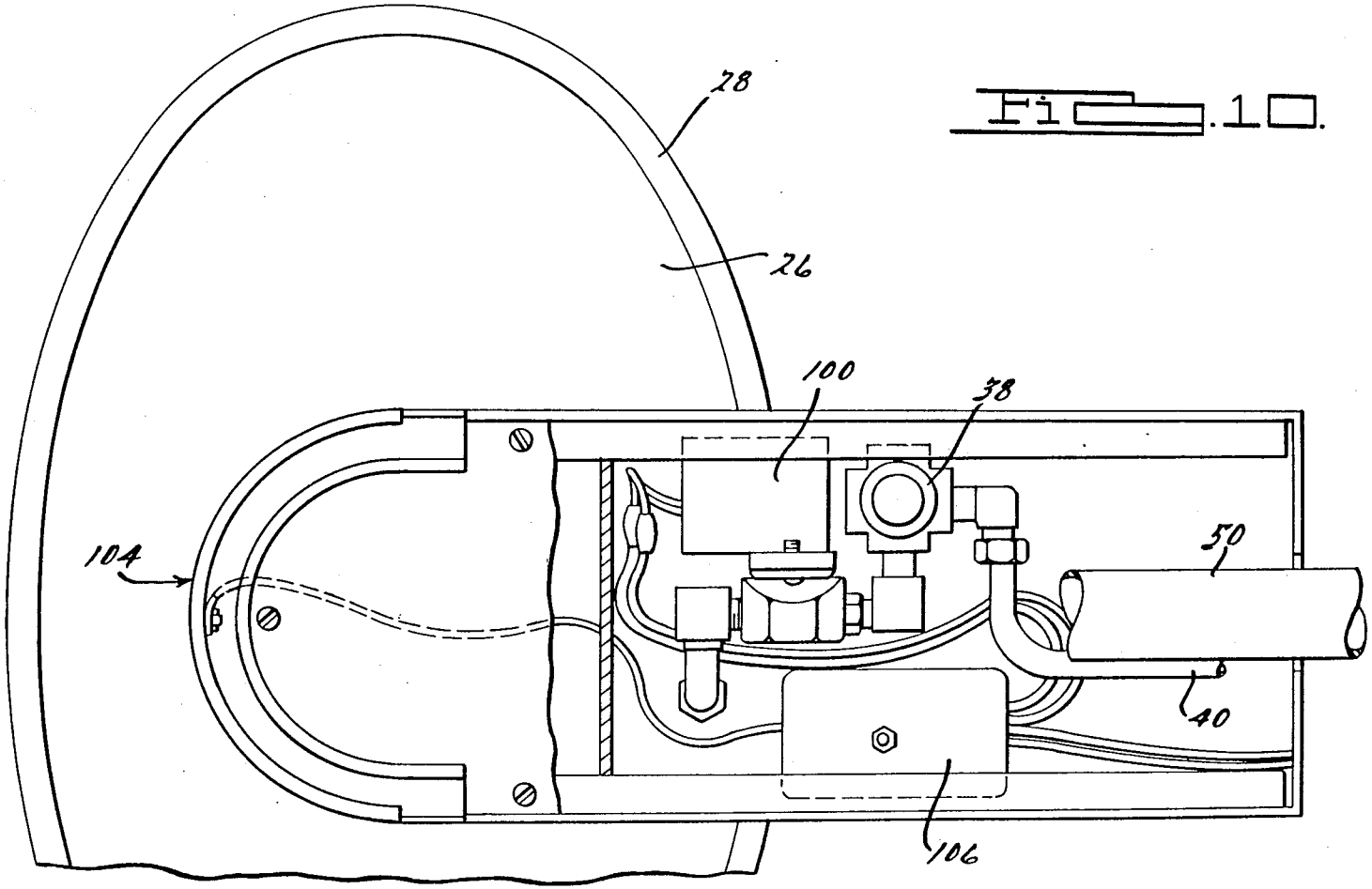
FIG. 10 depicts yet another embodiment of actuator.

While a mechanical valve with spring biased valve stem has been illustrated, the invention may also be implemented using electrically operated solenoid valves. In such an embodiment, seen in FIG. 9, the push actuator 34 would be situated to apply a pushing force through contacting portion 64 to an electrical switch 102. The switch would in turn energize an electrically actuated solenoid 100. In the alternative, other forms of electrically actuable switches may be employed. For example, a capacitance touch pad 104, shown in FIG. 10, may be located on the front of the fountain, such as on the semicylindrically curved frontal portion of the arm. The capacitance touch pad 104 is coupled through control module 106 to solenoid 100 and is operated by touching. No substantial pushing force is required. The touching of the capacitance switch causes a low voltage logic circuit to be closed, sending a signal to activate solenoid 100 used to control water flow. An intermediate electronic driver circuit or relay may be used to provide sufficient driving force to operate the solenoid, if required. The capacitance switch may be a strip spanning the width of the frontal portion of the arm 14. Such a strip may be fashioned in a U shape so that it spans the frontal portion as well as the left and right sides of the arm 14. In the alternative, a plurality of shorter segments located on the frontal and two side portions of the arm may be employed.

Figure 11:
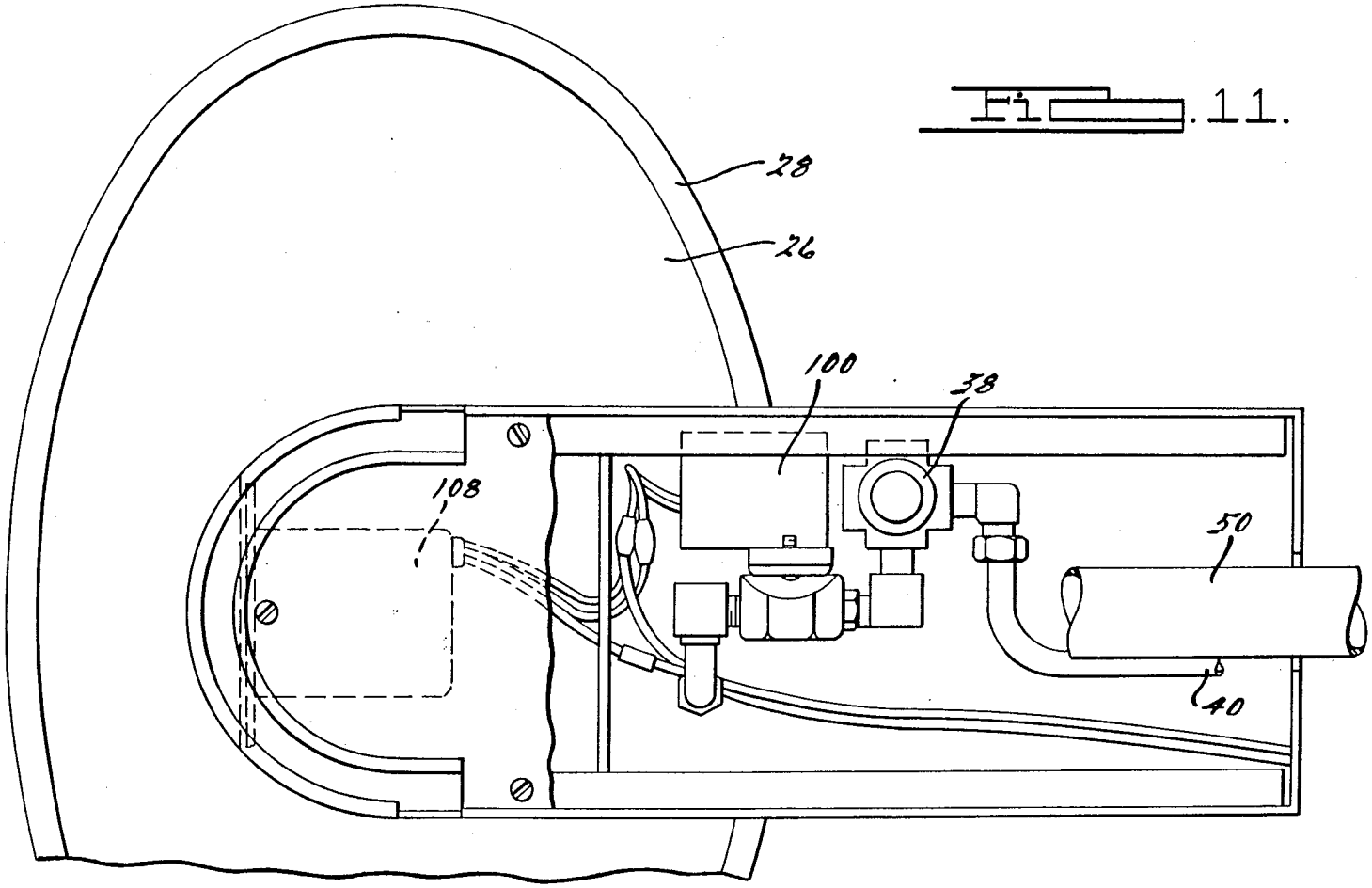
FIG. 11 depicts yet another embodiment of actuator.

Another alternative means of actuation, shown in FIG. 11, is an infrared sensor located on the frontal portion of arm 14, on one or both sides of arm 14, or combinations thereof. The infrared sensor comprises a sensor module 108 which emits an infrared beam which is interrupted by the presence of a person or object in the beam's path. The infrared sensor sends an internal logic signal to a control circuit board which determines whether the beam has remained interrupted for a predetermined time period. If such is the case, a relay is activated which in turn activates the electrically actuated solenoid 100. The infrared sensor may be of the type that emits either a continuous or a pulsed beam. Alternatively, either a photoelectric or a photoreflective beam emitter can also be used to transmit the desired signal. Such an embodiment would require no physical activity on the part of the person desiring to drink from the fountain, except positioning his body in the correct or directed location. A strategically placed infrared sensor requires no action except approaching the water cooler and placing one's mouth in the area where water is dispensed. Radar sensors can also be used in place of infrared sensors.

To facilitate cleaning and repair, the present invention employs a basin and drain construction which allows the drain system to be removed for service. The drain assembly holds the lower bowl to the upper bowl in a fashion which makes it easy to gain access to the space between the bowls in order to fix water leaks. Leaks are less of a problem with the present invention due to its construction, however.

Figure 8:
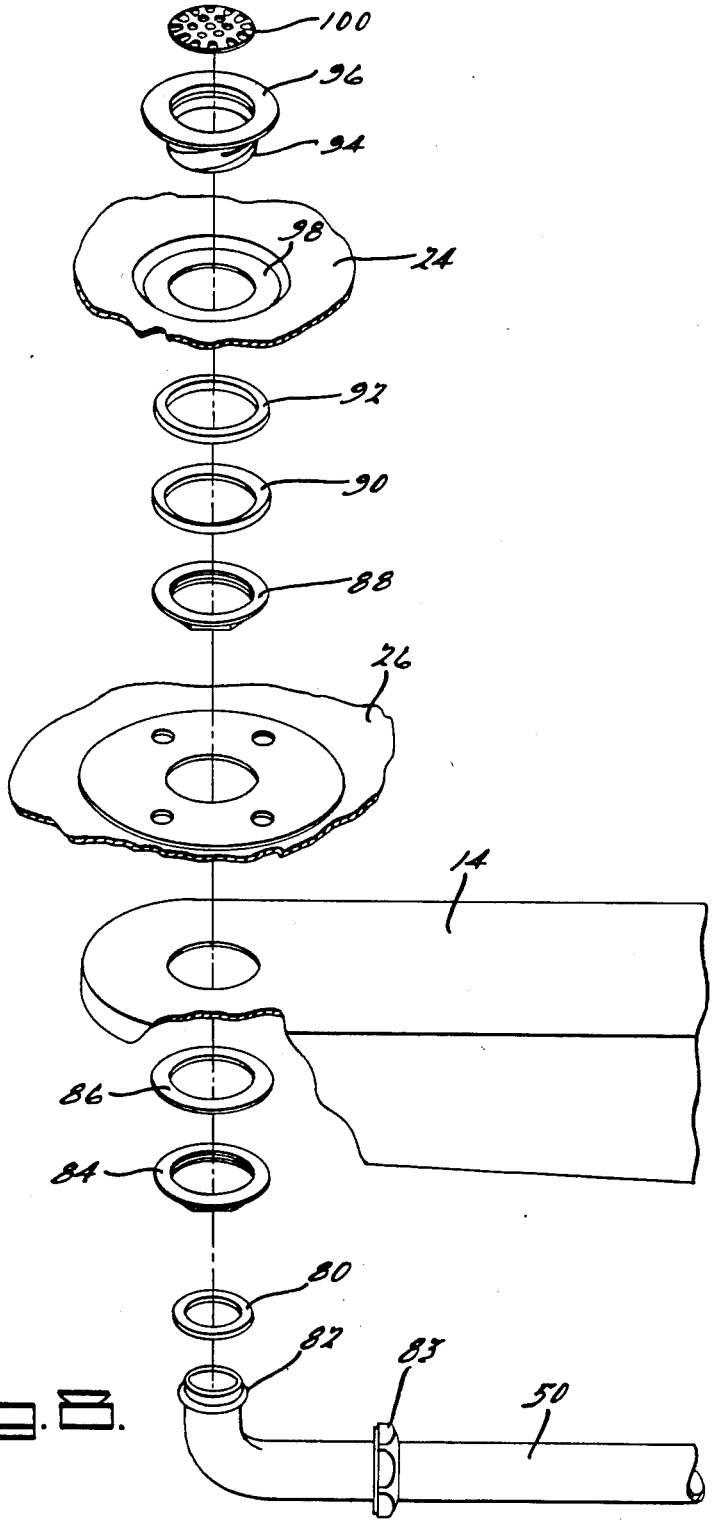
FIG. 8 is a fragmentary exploded perspective view illustrating the manner of assembly of the receptor basin on the carrier arm base.

FIG. 8 illustrates the manner in which the drain assembly and upper and lower bowls fit together. In FIG. 8, the upper bowl 24 and the lower bowl 26 have been fragmented to simplify illustration. The upper and lower bowls are assembled on the waste tube 50 and positioned above carrier arm base 14. Starting at the top of FIG. 8, the assembly begins by inserting threaded drain plug 94 through the upper bowl 24 so that the flanged rim 96 fits in the annular recess 98 formed in the upper bowl 24. From the underside of upper bowl 24 a drain gasket 92 and brass packing ring 90 are then assembled on the threaded end of the drain plug 94. Next a threaded drain nut 88 is secured to the threaded end of the drain plug 94. The upper bowl 24 is thus secured to the drain plug 94. The threaded end of drain plug 94 is then inserted through lower bowl 26 and through carrier arm 14. From the underside of carrier arm 14 a friction ring 86 is inserted on the threaded end of the drain plug 94, followed by a second drain nut 84, which is threaded onto the end of drain plug 94. This secures the upper and lower bowl assembly to carrier arm 14. Finally, a waste tube gasket 80 is assembled on the flanged rim 82 of waste tube 50 and the waste tube nut 83 is used to secure the waste tube to the assembly by threading nut 83 onto the end of threaded drain plug 94. A strainer plate 100 is frictionally inserted in the drain plug opening to finish the assembly.

The construction thus described, serves to hold the upper and lower bowls together without the need for adhesive seals or the like. The drain plug 94 is threaded into the drain nut which virtually eliminates the likelihood of a leak developing in the drain system which might fill the space between the upper and lower bowls. The assembly is nevertheless quite easy to service.

In order to disassemble the fountain for service, the lower drain nut 84 can be unthreaded from drain plug 94 to allow the friction ring 86 to be replaced. This also permits the removal of the lower bowl. Finally, if desired, the drain nut 88 can be unthreaded from the drain plug 94 to allow the gasket 92 and packing ring 90 to be replaced. Under normal conditions, it should not be necessary to disassemble the unit, since the drain pipe is continuous from upper to lower bowl.

While the invention has been described in connection with the presently preferred embodiment, it will be understood that the invention is capable of certain modification and change without departing from the spirit of the invention as set forth in the appended claims. For example, while a generally semicylindrical push actuator has been illustrated, the invention can be implemented using arcuate, U-shaped or V-shaped configurations to conform to other types of fountains.

What is claimed is:

1. In a drinking fountain having a water basin with a drain therein and having a water dispensing means, the improvement comprising:

a push actuator operatively coupled to said water dispensing means for controlling the dispensing of water;

said actuator having a stationary mounting portion secured to said fountain and having a movable manually contactable portion carried by said mounting portion;

said manually contactable portion being carried for translational movement and for rotational movement about at least one axis from a position of rest;

said manually contactable portion comprising a rigid push bar which provides a frontally facing portion and at least one laterally facing portion;

wherein manually applied forces to said frontally facing portion cause said translational movement and manually applied forces to said laterally facing portion cause said rotational movement; and wherein said translational movement and said rotational movement cause the dispensing of water from said dispensing means.

2. The drinking fountain of claim 1 wherein said manually contactable portion is carried for rotational movement about at least two axes from said position of rest.

3. The drinking fountain of claim 2 wherein said two axes are parallel.

4. The drinking fountain of claim 1 further comprising a base means for supporting said basin and wherein said push actuator is disposed in said base means.

5. The drinking fountain of claim 1 wherein said manually contactable portion lies at least partially in a cylindrical plane.

6. The drinking fountain of claim 1 wherein said manually contactable portion comprises a semicylindrical push bar.

7. The drinking fountain of claim 4 wherein said base means includes a frontal portion which defines a semicylindrical plane and wherein said manually contactable portion comprises a semicylindrical push bar which lies generally in said semicylindrical plane.

8. The drinking fountain of claim 4 wherein said base means comprises a generally horizontally extending cantilevered structure.

9. The drinking fountain of claim 1 wherein said water basin is generally oval-shaped.

10. The drinking fountain of claim 1 wherein said water basin comprises a generally oval-shaped top bowl and a lower bowl interfitted with said top bowl.

11. In a drinking fountain having a water basin with a drain therein and having a water dispensing means, the improvement comprising:

a push actuator operatively coupled to said water dispensing means controlling the dispensing of water;

said actuator having a stationary mounting portion secured to said fountain and having a movable manually contactable portion carried by said mounting portion;

said manually contactable portion being carried for rotational movement about at least two axes from a position of rest;

said manually contactable portion comprising a rigid push bar which provides a frontally facing portion and at least one laterally facing portion;

wherein manually applied forces to said frontally facing portion cause said translational movement and manually applied forces to said laterally facing portion cause said rotational movement; and wherein said rotational movement causes the dispensing of water from said dispensing means.

12. The drinking fountain of claim 11 wherein said two axes are parallel.

13. The drinking fountain of claim 11 further comprising base means for supporting said basin and wherein said push actuator is disposed in said base means.

14. The drinking fountain of claim 11 wherein said manually contactable portion lies at least partially in a cylindrical plane.

15. The drinking fountain of claim 11 wherein said manually contactable portion comprises a semicylindrical push bar.

16. The drinking fountain of claim 13 wherein said base means includes a frontal portion which defines a semicylindrical plane and wherein said manually contactable portion comprises a semicylindrical push bar which lies generally in said semicylindrical plane.

17. The drinking fountain of claim 13 wherein said base means comprises a generally horizontally extending cantilevered structure.

18. The drinking fountain of claim 11 wherein said water basin is generally oval-shaped.

19. The drinking fountain of claim 11 wherein said water basin comprises a generally oval-shaped top bowl and a lower bowl interfitted with said top bowl.

20. In a drinking fountain having a water basin with a drain therein and having a water dispensing means, the improvement comprising:

a manual actuator operatively coupled to said water dispensing means for controlling the dispensing of water;

said actuator having a manually contactable actuator surface which is continuous and lies at least partially in a cylindrical plane and is disposed generally beneath said water dispensing means;

said actuator surface defining a frontally facing portion and at least one laterally facing portion;

wherein manually applied contact to either of said frontally facing portion and said laterally facing portion causes dispensing of water from said dispensing means.

* * * * *